US005404928A

United States Patent [19]

Ota et al.

[11] Patent Number: 5,404,928

[45] Date of Patent: Apr. 11, 1995

[54] VACUUM CASTING METHOD

[75] Inventors: Atsushi Ota, Toyota; Tamotsu Hasegawa; Yasuyuki Arakawa, both of Nagoya, all of Japan

[73] Assignee: Toyota Jidosha Kabushiki Kaisha, Toyota, Japan

[21] Appl. No.: 263,083

[22] Filed: Jun. 21, 1994

[30] Foreign Application Priority Data

Jun. 29, 1993 [JP] Japan ..... 5-158973

[51] Int. Cl.[6] ..... B22D 18/04; B22D 18/06

[52] U.S. Cl. ..... 164/63; 164/119; 164/120

[58] Field of Search ..... 164/63, 119, 120, 254, 164/306, 309

[56] References Cited

FOREIGN PATENT DOCUMENTS

| | | | |
|---|---|---|---|
| 0559920 | 9/1993 | European Pat. Off. . | |
| 1331641 | 5/1963 | France . | |
| 58-32564 | 2/1983 | Japan | 164/63 |
| 61-182868 | 8/1986 | Japan . | |
| 2-155557 | 6/1990 | Japan . | |
| 3-23051 | 1/1991 | Japan | 164/120 |
| 3-31058 | 3/1991 | Japan . | |
| 3-68955 | 7/1991 | Japan . | |
| 3-198969 | 8/1991 | Japan . | |
| 4-158968 | 6/1992 | Japan . | |
| 4-274860 | 9/1992 | Japan . | |
| 5-123845 | 5/1993 | Japan . | |
| 5-146863 | 6/1993 | Japan . | |
| 5-146864 | 6/1993 | Japan . | |
| 5-146865 | 6/1993 | Japan . | |
| 5-169232 | 7/1993 | Japan . | |
| 5-192759 | 8/1993 | Japan . | |
| 5-63264 | 9/1993 | Japan . | |

OTHER PUBLICATIONS

Abstract of Japan vol. 17, No. 618 Re: Japanese Patent Publication 5-192759 published Aug. 3, 1993.

*Primary Examiner*—J. Reed Batten, Jr.

*Attorney, Agent, or Firm*—Cushman Darby & Cushman

[57] ABSTRACT

In a vacuum casting method, a mold cavity is reduced in pressure to a vacuum, and when a gate is opened, a molten metal which has been raised to a molten metal retaining dome is charged into the cavity at a high speed. When a portion of a molten metal held in a molten metal holding furnace is raised to the molten metal retaining dome, an upper surface of the molten metal is moved downwardly and upwardly through at least one cycle in the molten metal retaining dome, or a swirl flow is generated in the molten metal in a stalk. Such a unique motion as the downward and upward motion or the swirl flow effectively operates to detach solid metal pieces from an inside surface of the molten metal retaining dome or the stalk to push them to an upper portion of the molten metal. As a result, the detached metal pieces are prevented from being charged into the mold cavity to thereby cause defects in a cast product.

18 Claims, 3 Drawing Sheets

VACUUM CASTING METHOD

BACKGROUND OF THE INVENTION

1. Field of the Invention

The present invention relates to a vacuum casting method of the type wherein a mold cavity is reduced in pressure to a vacuum and upon opening a gate, a molten metal is charged into the cavity at a high speed. More particularly, the present invention relates to an improved vacuum casting method in which bubbles and solid metal pieces are prevented from being involved in the molten metal charged into the cavity.

2. Description of the Related Art

As one example of a light alloy casting method of a high quality and a low cost, a vacuum casting method (named by the present applicant as a Vacuum Precharged Closed squeezed casting method) was proposed by the present applicant in Japanese Patent Application No. HEI 4-309534 filed on Oct. 23, 1992.

In the proposed vacuum casting method, a mold cavity is shut off from an interior of a molten metal retaining dome by a gate. Then, the cavity is reduced in pressure to a vacuum, and substantially simultaneously a portion of a molten metal held in a molten metal holding furnace is raised to the molten metal retaining dome. Then, the gate is opened so that the molten metal in the molten metal retaining dome is charged into the cavity at a high speed due to the vacuum in the cavity. The cavity is shut off by a shut pin, and then the molten metal in the cavity is pressurized by inserting a pressure pin into the cavity. Then, the molten metal in the cavity is cooled to be solidified.

In the proposed vacuum casting method, since the mold cavity is reduced in pressure to a vacuum before the molten metal is charged, the molten metal in the cavity has few or no bubbles, so that casting defects due to bubbles are avoided and casting quality is improved. Further, because of the vacuum generated in the cavity, the charging speed of the molten metal is very high, so that the molten metal can smoothly run in the cavity and, as a result, slimmer and lighter cast products is possible.

However, some additional problems remain in the above-described vacuum casting method. For example, during repeating the casting cycles, solid metal pieces generated in the previous casting cycles, which may be additionally oxidized, often adhere to an inside surfaces of a stalk connecting the molten metal retaining dome and the molten metal holding furnace and/or the molten metal retaining dome. When the molten metal is raised through the stalk to the molten metal retaining dome, the rising molten metal often involves air formed at the solid metal pieces adhering to the surface. The involved air may be suspended in the molten metal as bubbles without floating up to the upper surface of the molten metal. When the gate is opened and a portion of the molten metal located in the vicinity of the gate is charged into the cavity, the bubbles suspended in the molten metal and the solid metal pieces detached from the inside surfaces of the stalk and the dome are sucked into the mold cavity together with the molten metal, thereby generating casting defects. Thus, to improve the quality of cast products, air and solid metal pieces should be prevented from being mixed with the molten metal.

SUMMARY OF THE INVENTION

An object of the present invention is to provide a vacuum casting method wherein bubbles and solid metal pieces are prevented from being mixed with a molten metal charged into a mold cavity.

The above-described object is achieved by a vacuum casting method in accordance with the present invention, wherein during raising a portion of a molten metal from a molten metal holding furnace via a stalk to a molding metal retaining dome, a unique motion is imparted to the raised portion of the molten metal to detach solid metal pieces adhering to an inside surface of the molding metal retaining dome and/or the stalk. In addition, the molten metal undergoes a monotonic raising motion. The unique motion may be at least one cycle of downward and upward motion of an upper surface of the molten metal generated in the molten metal retaining dome, and may be a swirl flow generated in the molten metal inside the stalk.

In the above-described vacuum casting method of the present invention, solid metal pieces are separated from inside surface of the molten metal retaining dome and/or the stalk by the unique motion of the molten metal so as to rise to the upper surface of the molten metal together with bubbles held by the solid metal pieces, so that the solid metal pieces and bubbles are eliminated from the portion of the molten metal that will be sucked into the mold cavity when the gate is opened.

More particularly, in the case where the imparted unique motion is at least one cycle of downward and upward motion of the molten metal, at the first rising of the molten metal, the solid metal pieces adhering to the surface of the dome which contact the molten metal will be melted or softened and thus will be easily detached from the surface. Then, at the second rising of the molten metal, the melted or softened metal pieces will be detached from the surface and will be pushed by the motion of the molten metal to be raised to the upper portion of the molten metal together with bubbles held by the detached metal pieces.

In the case where the unique motion is a swirl flow generated in the molten metal, since the swirling flow strengthens the molten metal motion, the strengthened molten metal motion effectively detaches the solid metal pieces adhering to the inside surface of the stalk and the molten metal retaining dome from the surface due to the shear force, so that the detached metal pieces will be pushed by the molten metal and be raised to the upper portion of the molten metal together with the bubbles adhered to the pieces.

BRIEF DESCRIPTION OF THE DRAWINGS

The above and other objects, features, and advantages of the present invention will become more apparent and will be more readily appreciated from the following detailed description of the preferred embodiments of the invention taken in conjunction with the accompanying drawings, in which.

DETAILED DESCRIPTION OF THE PREFERRED EMBODIMENTS

Figure 5:
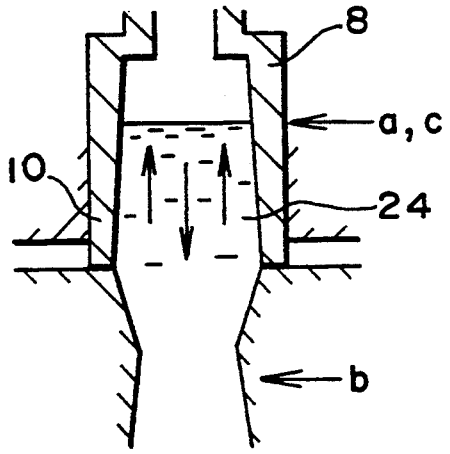
FIG. 5 is a cross-sectional view of a molten metal retaining dome and a vicinity thereof in a state where molten metal is moved downwardly and upwardly in the molten metal retaining dome in a method in accordance with a first embodiment of the invention.
Figure 6:
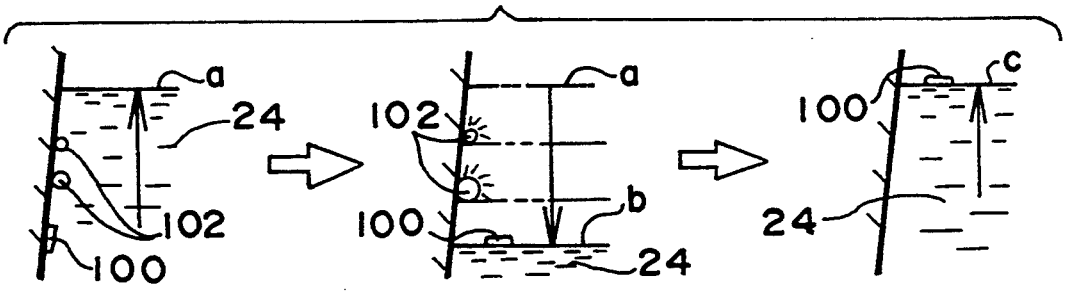
FIG. 6 is a cross-sectional view of an inside surface of the molten metal retaining dome and a vicinity thereof in a state where solid metal pieces adhering to the surface and bubbles held by the metal pieces are detached from the surface due to the downward and then upward motion of the molten metal in the molten metal retaining dome.
Figure 7:
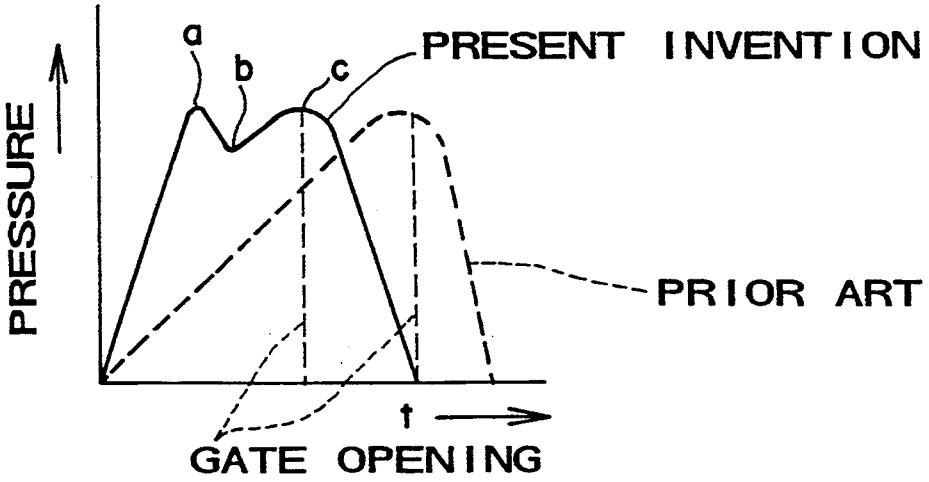
FIG. 7 is a graphical representation of a pressure versus time characteristic for controlling the downward and upward motion of the molten metal in the molten metal retaining dome.
Figure 8:
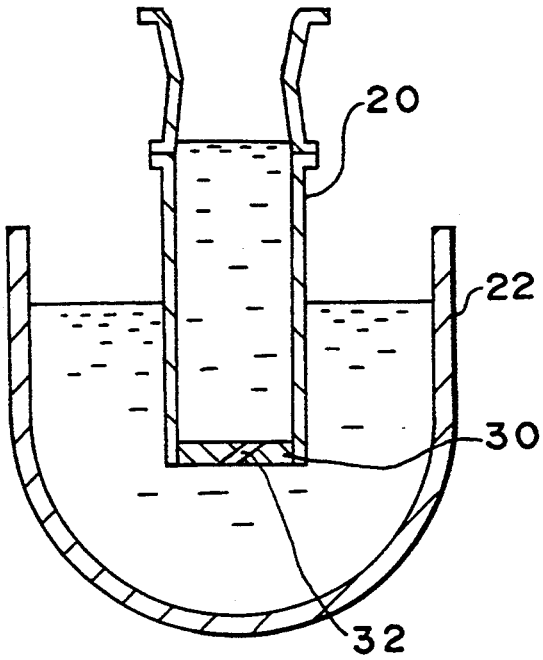
FIG. 8 is a cross-sectional view of a stalk having a swirl flow generating device and a vicinity thereof in accordance with a second embodiment of the invention.
Figure 9:
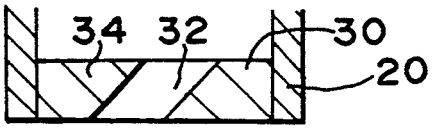
FIG. 9 is an enlarged cross-sectional view of the swirl flow generating device of FIG. 8.
Figure 10:
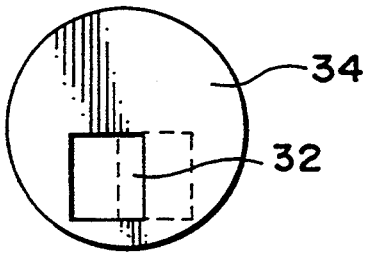
FIG. 10 is a plan view of the swirl flow generating device of FIG. 9.

FIGS. 1–4 illustrate structures common to all the embodiments of the invention. FIGS. 5–7 illustrate structures specific to a first embodiment of the invention, and FIGS. 8–10 illustrate structures specific to a second embodiment of the invention. Throughout all the embodiments of the invention, portions having the same or similar structures are denoted with the same reference numerals.

First, structures and operation common to all the embodiments of the invention will be explained with reference to FIGS. 1–4.

A casting apparatus for conducting a vacuum casting method of the invention does not have a molten metal injection mechanism like the conventional high pressure casting apparatus or the conventional die casting apparatus. Thus, the apparatus of the present invention is much simpler than those conventional apparatuses. Compared with the conventional low pressure casting apparatus, the vacuum casting apparatus of the present invention is provided with a gate for shutting off the mold cavity and a pressure reducing mechanism for reducing the pressure in the cavity, so that the cavity can be charged with a molten metal at a high speed using a pressure difference between the vacuum generated in the cavity and the atmospheric pressure retained in the molten metal retaining dome.

More particularly, a molding die assembly which includes an upper die 2 and a lower die 4 is capable of being open and closed by moving the upper die 2 relative to the lower die 4 in a vertical direction. The upper die 2 and the lower die 4 define at least one mold cavity 6 therebetween. In the embodiment of FIGS. 1–4, a plurality of cavities 6 are arranged around a molten metal retaining dome 8, which is located at a central portion of the molding die assembly, and extend radially. The cavity 6 can be shut off or be isolated from the interior of the molten metal retaining dome 8 by a gate 10 which is formed at a lower end of the molten metal retaining dome 8. The cavity 6 is connected to a pressure reducing pump (not shown) via a suction port 26 and can be reduced in pressure to a vacuum after the molding die assembly is closed and the cavity 6 is shut off by the gate 10.

The molten metal retaining dome 8 communicates with a molten metal holding furnace 22 via a sprue 12 formed in the lower die 4 and a stalk 20 connecting the sprue 12 to the molten metal holding furnace 22. The molten metal holding furnace 22 is housed in a closed chamber, and a pressure of an interior of the closed chamber can be controlled by a pressure pump (not shown) connected to the closed chamber via a pressure port 28. When the pressure of the interior of the closed chamber is increased and the increased pressure acts on a free surface of the molten metal held in the molten metal holding furnace 22, a portion of the molten metal 24 held in the molten metal holding furnace 22 is raised into the molten metal retaining dome 8.

A shut pin 16 movable relative to the upper die 2 is provided to a runner 14 connecting the interior of the molten metal retaining dome 8 and the cavity 6. The cavity 6 is shut off or isolated from the interior of the molten metal retaining dome 8 by the shut pin 16 after the molten metal has been charged into the cavity 6. A pressure pin 18 movable relative to the upper die 2 is provided in the cavity 6, and the molten metal charged into the cavity 6 can be pressurized by inserting the pressure pin 18 into the cavity 6 before the molten metal in the cavity 6 is solidified.

Figure 1:
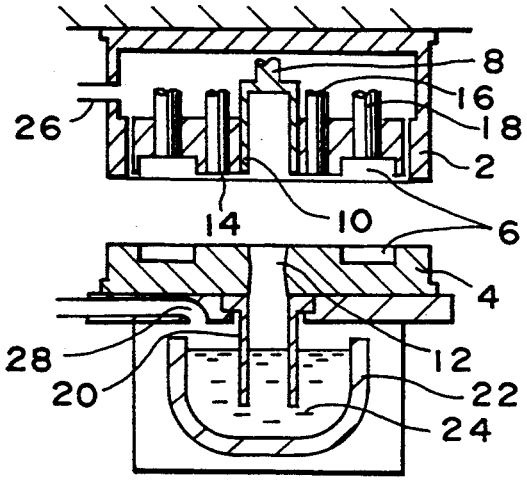
FIG. 1 is a cross-sectional view of a casting apparatus, in a state where dies are opened, for conducting a vacuum casting method in accordance with the present invention.
Figure 2:
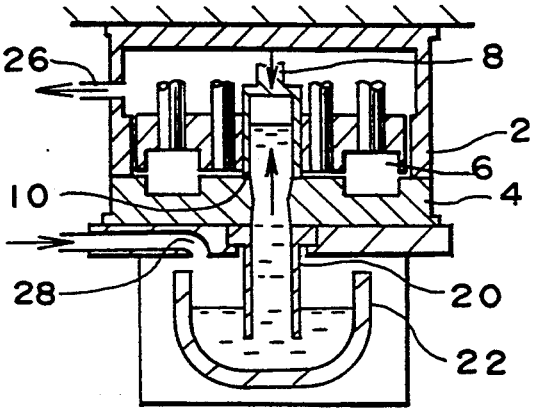
FIG. 2 is a cross-sectional view of the apparatus of FIG. 1 in a state where the dies have been closed and a mold cavity has been reduced in pressure.

Using the above-described apparatus, a vacuum casting method of the invention is conducted as follows:

First, the molding die assembly is closed, by which the state of the casting apparatus shown in FIG. 1 is changed to a state shown in FIG. 2. Then, the molten metal retaining dome 8 is lowered relative to the upper die 2, so that the gate 10 isolates the cavity 6 from the interior of the molten metal retaining dome 8 which communicates with atmosphere. Then, the cavity 6 is reduced in pressure to a vacuum by operating the pressure reducing pump connected to cavity 6 via the suction port 26. The vacuum to be generated in the cavity 6 is higher than about 50 torr, and preferably higher than about 20 torr, and most preferably about 10 torr. Because a vacuum of 50–100 torr is used in the conventional vacuum die casting, the vacuum casting of the invention can be distinguished from the conventional vacuum die casting. Casting products having a high quality as that of the conventional vacuum die casting can be obtained at a higher vacuum than 20 torr in the method of the invention. Substantially simultaneously with reduction of the pressure in the cavity 6, the pressure acting on the free surface of the molten metal held in the molten metal holding furnace 22 is increased so that a portion of the molten metal 24 held in the furnace 22 is raised into the molten metal retaining dome 8. The rising speed of an upper surface of the molten metal in the molten metal retaining dome 8 is about 5–10 cm/sec. When increase in the gas pressure acting on the molten metal held in the furnace 22 is stopped, the upper surface of the molten metal in the molten metal retaining dome 8 may oscillate for a few seconds due to a cushion effect of the gas inside the closed chamber in which the furnace 22 is housed.

When a portion of the molten metal held in the molten metal holding furnace 22 is raised up to the molten metal retaining dome 8, a unique motion which operates to detach the solid metal pieces adhering to the inside surface of the molten metal retaining dome and/or the stalk from the surface is imparted to the rising molten metal in addition to a monotonic rising motion of the molten metal.

Figure 3:
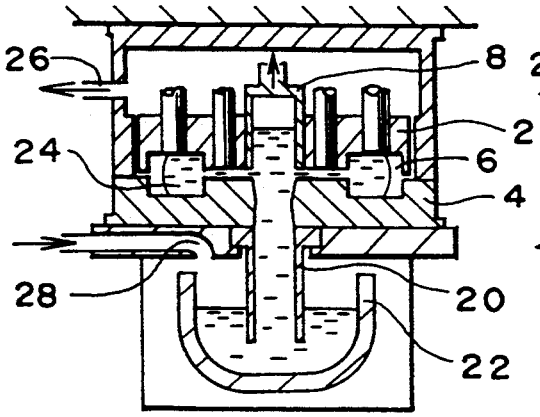
FIG. 3 is a cross-sectional view of the apparatus of FIG. 1 in a state where molten metal is charged into the cavity.

Then, as illustrated in FIG. 3, the gate 10 is opened so that the molten metal 24 in the molten metal retaining dome 8 is charged into the cavity 6 at a high speed due to a pressure difference between the vacuum in the cavity 6 and the atmospheric pressure retained inside the molten metal retaining dome 8. The charging speed of the molten metal running in the cavity 6 is about 7 m/sec. This speed is much higher than the charging speed of molten metal in the conventional low casting that is 0.5 m/sec. This high charging speed improves the running characteristic of molten metal in the cavity and allows thinner cast products to be formed. Though such a high speed is obtained in conventional die casting, the molten metal tends to have bubbles, and also, a hydraulic cylinder needs to be provided in conventional die casting. In contrast, in the vacuum casting method of the present invention, no bubbles are mixed in the molten metal charged into the cavity, due to the vacuum generated in the cavity 6, and no casting defects will be generated.

Figure 4:
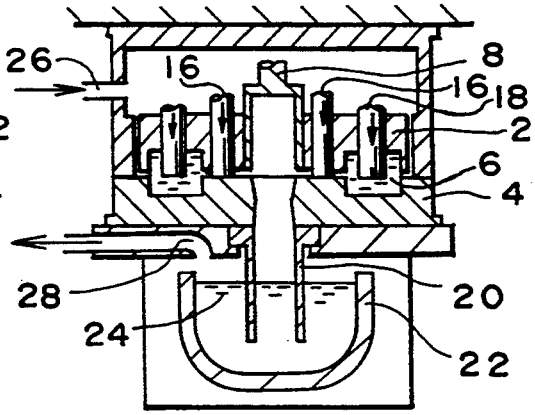
FIG. 4 is a cross-sectional view of the apparatus of FIG. 1 in a state where the cavity has been closed and a pressure pin is operated.

Then, as illustrated in FIG. 4, the shut pin 16 is lowered relative to the upper die 2 to shut the runner 14 and to close the cavity 6 filled with molten metal. Then, the pressure pin 18 is inserted into the cavity 6 filled with the molten metal to pressurize the molten metal. Then, the molten metal in the cavity 6 is cooled naturally or forcibly. While the molten metal is cooled, the gas pressure acting on the molten metal held in the the molten metal holding furnace 22 is released and the vacuum pressure generated in the cavity is released. After the molten metal has solidified, the molding die is opened, and the cast product is taken out from the molding die. The inside surface of the molding die defining the cavity is then coated with a mold release agent and is prepared for the next molding cycle.

Next, structures and operation specific to a vacuum casting method in accordance with each embodiment of the invention will be explained.

With the first embodiment of the invention, as illustrated in FIGS. 5–7, in the step of raising a portion of the molten metal held in the molten metal holding furnace 22 to the molten metal retaining dome 8, the upper surface of the molten metal is intentionally moved downwardly and upwardly at least once in the molten metal retaining dome 8. The unique motion imparted to the rising molten metal in the molten metal retaining dome 8 is the intentional downward and upward motion in the first embodiment of the invention. More particularly, as illustrated in FIG. 6, when the upper surface of the molten metal 24 has risen to a level higher than the runner 14, the upper surface of the molten metal is intentionally lowered, and then is again raised to a level higher than the runner 14. The range over which the upper surface of the molten metal is moved downwardly and then upwardly is a range in which a molten metal is expected to be sucked into the cavity 6 when the gate 10 is opened. The reason for selecting the range as described above is to eliminate detached metal pieces and bubbles from the sucked portion of the molding metal before that portion of the molten metal is actually sucked into the cavity 6. The downward and then upward motion of the upper surface of the molten metal in the molten metal retaining dome 8 is produced by controlling the gas pressure acting on the free surface of the molten metal held in the molten metal holding furnace 22. As illustrated in FIG. 7, the gas pressure of the molten metal holding furnace 22 is increased to point a, then is lowered to point b, and then is again increased to point c. Points a, b, and c of FIG. 7 correspond to points a, b, and c of FIG. 5. The dashed line of FIG. 7 illustrates a pressure change pattern in a case where the at least one cycle of downward and upward motion is not conducted. The rate of the increase in pressure at the second rising of the upper surface of the molten metal following the lowering of the molten metal is preferably lower than the rate of the increase in pressure at the first rising of the molten metal. As a result, the upper surface of the molten metal rises at a lower speed at the second rising than at the first rising.

At the first rising of the portion of the molten metal, as illustrated in FIG. 6, solid metal pieces 100, which may have been additionally oxidized, may be adhered to the inside surface of the molten metal retaining dome 8, and bubbles 102 may be held by the metal pieces 100 or be attached to the inside surface of the molten metal retaining dome 8. The adhered solid metal pieces 100 will be melted or softened when the pieces come into contact with the molten metal during the first rising of the molten metal, so that the pieces are easily detached from the surface when subjected to the motion of the molten metal.

When the upper surface of molten metal is lowered, the bubbles 102 rise to the upper surface and dissipate. When the upper surface of the molten metal is raised at the second rising, the adhered metal pieces are detached from the suface of the molten metal retaining dome 8 receiving the rising motion of the molten metal, and the detached metal pieces are pushed by the rising molten metal to rise to the surface or the upper portion of the molten metal. Since the rising speed is about 7 cm/sec, the motion of the molten metal is not small and is effective to detach the melted or softened metal pieces from the surface. If bubbles are adhered to such detached metal pieces, the bubbles rise to the surface of the molten metal together with the metal pieces and are released to the gas positioned inside the dome.

Since the upper portion of the molten metal where the detached metal pieces are raised is distanced by a considerably large distance from the runner 14, the detached metal pieces will not flow into the cavity 6 through the runner 14 when the gate 10 is opened. Despite the motion of the molten metal, some solid pieces may remain attached to the inside surface of the dome 8. However, this means that such pieces would continue to adhere to the surface of the dome 8 even if they are exposed to the flow of the molten metal sucked into the cavity 6 when the gate 10 is opened. As a result, they cause no problem.

Thus, the portion of the molten metal sucked into the cavity 6 after the upper surface of the molten metal has been oscillated downwardly and upwardly in the molten metal retaining dome 8 has substantially no detached solid metal pieces and no bubbles, so that the quality of resultant cast products is improved. Further, at the second rising of the upper surface of the molten metal, since the surface of the molten metal retaining dome 8 has been previously contacted by molten metal, air bubbles are unlikely to occur at the inside surface of the dome 8.

In the second embodiment of the invention, as illustrated in FIGS. 8–10, a swirl flow generating device 30 is provided at a lower end of the stalk 20. The device 30 generates a swirl flow in the molten metal 24 when the molten metal flows from the molten metal holding furnace 22 through the device 30 into the stalk 20. As illustrated in FIG. 10, the device 30 is constructed of a plate 34 having a hole 32 formed therein. The hole 32 penetrates the plate 34 at a position offset from a center of the plate are seen in FIG. 10 and is directed tangentially to a transverse cross section of the stalk 20. When the molten metal 24 passes through the hole 32, a swirl flow is generated in the molten metal rising in the stalk 20.

The molten metal 24 rising in the stalk 20 therefore has a composite motion of the swirling motion and a monotonic rising motion of the molten metal, which is stronger than the monotonic rising motion only. The strong motion will effectively detach solid metal pieces adhering to the inside surface of the stalk 20 by a shear force and will raise the detached pieces to the upper portion of the molten metal. Further, the swirl flow generates a centrifugal force in the molten metal, which pushes the molten metal against the inside surface of stalk 20. As a result, bubbles adhered to the metal pieces will be broken or detached by the pushing force and will be raised to the upper surface of the molten metal. As a result, solid metal pieces and bubbles are unlikely to be mixed in a portion of the molten metal which will be sucked into the cavity 6 when the gate 10 is opened.

Some solid metal pieces may remain adhered to the inside of the stalk 20 despite the strong swirling flow of the molten metal. However, such adhered metal pieces will also not be detached even if the pieces receive the motion of the molten metal sucked into the cavity 6 when the gate 10 is opened, and will therefore cause no trouble.

According to the invention, the following advantages will be obtained.

Since a unique motion is imparted to the molten metal, the solid metal pieces adhering to the inside surface of the molten metal retaining dome 8 and/or the stalk 20 are easily detached therefrom and are moved to the upper portion or the upper surface of the molten metal inside the dome 8. As a result, such detached metal pieces and air bubbles adhered to the pieces are prevented from being sucked into the cavity 6 when the gate 10 is opened, so that resultant cast products will not have casting defects.

In the case where the unique motion is at least one cycle of a downward and upward motion, the second upward motion of the molten metal effectively operates to detach melted or softened metal pieces and the bubbles held by the pieces from the inside surface of the molten metal retaining dome 8.

In the case where the unique motion is a swirl flow generated in the molten metal during rising in the stalk 20, the rising motion of the molten metal is strengthened by the swirl flow, so that solid metal pieces and bubbles held by the pieces are effectively detached from the surface, and castings of a high quality can be obtained.

Although only a few embodiments of the invention have been described in detail above, it will be appreciated by those skilled in the art that various modifications and alterations can be made to the particular embodiments shown without materially departing from the novel teachings and advantages of the present invention. Accordingly, it is to be understood that all such modifications and alterations are included within the spirit and scope of the present invention as defined by the following claims.

What is claimed is:

1. A vacuum casting method comprising the steps of:

shutting a gate to isolate a mold cavity defined between an upper die and a lower die from the interior of a molten metal retaining dome which communicates with a molten metal holding furnace via a hollow stalk;

reducing the pressure in the mold cavity, while moving a portion of a molten metal held in the molten metal holding furnace to the molten metal retaining dome;

opening the gate to charge the molten metal in the molten metal retaining dome into the cavity; and shutting off the cavity filled with the molten metal, pressurizing the molten metal in the cavity, and allowing the molten metal in the cavity to solidify, wherein during said step of moving a portion of the molten metal to the molten metal retaining dome, imparting a motion to the molten metal for detecting solid metal pieces adhered to an inside surface of at least one of the molten metal retaining dome and the stalk.

2. A vacuum casting method according to claim 1, wherein the gate is provided at a lower end of the molten metal retaining dome, and during said gate shutting step, the molten metal retaining dome is lowered relative to the upper die.

3. A vacuum casting method according to claim 1, wherein during said step of reducing the pressure in the mold cavity, the pressure in the mold cavity is reduced to about 50 torr.

4. A vacuum casting method according to claim 1, wherein during said step of reducing the pressure in the mold cavity, the pressure in the mold cavity is reduced to about 20 torr.

5. A vacuum casting method according to claim 1 wherein during said step of reducing the pressure in the mold cavity, the pressure in the mold cavity is reduced to about 10 torr.

6. A vacuum casting method according to claim 1, wherein during said step of moving molten metal, said molten metal is raised at a speed of about 5–10 cm/sec inside the molten metal retaining dome.

7. A vacuum casting method according to claim 1, wherein during said step of charging the molten metal into the mold cavity, the molten metal is charged using a pressure difference between a substantially atmospheric pressure inside the molten metal retaining dome and a vacuum pressure generated inside the mold cavity.

8. A vacuum casting method according to claim 1, wherein the charging speed of the molten metal is about 7 m/sec.

9. A vacuum casting method according to claim 1, further comprising installing a shut pin movable relative to the upper die, and during said step of shutting off the mold cavity, lowering the shut pin relative to the upper die to block a runner connecting the mold cavity and the interior of the molten metal retaining dome.

10. A vacuum casting method according to claim 1, further comprising installing a pressure pin movable relative to the upper die, and during said step of pressurizing the molten metal in the mold cavity, inserting the pressure pin into the molten metal charged in the mold cavity before solidification of the molten metal in the mold cavity.

11. A vacuum casting method according to claim 1, wherein the motion imparted to the molten metal is at least one cycle of a downward and upward motion of an upper surface of the molten metal in the molten metal retaining dome.

12. A vacuum casting method according to claim 11, wherein the upper surface of the molten metal is lowered from a level higher than a runner connecting the mold cavity and the interior of the molten metal retaining dome to a level lower than the runner, and then is raised to a level higher than the runner.

13. A vacuum casting method according to claim 11, wherein the upper surface of the molten metal is moved downwardly and upwardly over a range corresponding to a portion of the molten metal which is sucked into the mold cavity when the gate is opened.

14. A vacuum casting method according to claim 11, wherein the downward and upward motion of the molten metal is produced by controlling the gas pressure acting on the molten metal held in the molten metal holding furnace.

15. A vacuum casting method according to claim 11, wherein during the upward, then downward, and then upward motion of the upper surface of the molten metal, the speed of the second upward motion is set to be lower than the speed of the first upward motion.

16. A vacuum casting method according to claim 1, wherein the motion imparted to the molten metal is a swirl flow.

17. A vacuum casting method according to claim 16, wherein a swirl flow generating device is disposed at a lower end of the stalk for generating a swirl flow in the molten metal as the molten metal passes therethrough.

18. A vacuum casting method according to claim 17, wherein the swirl flow generating device comprises a plate having a hole formed therein and directed at an angle with respect to a transverse cross section of the stalk, such that when the molten metal passes through the hole, a swirl flow is generated in the molten metal.

* * * * *